US007967159B2

(12) United States Patent
Miceli et al.

(10) Patent No.: US 7,967,159 B2
(45) **Date of Patent: *Jun. 28, 2011**

(54) REVERSIBLE CHILD RESISTANT CAP AND COMBINATION OF A CONTAINER AND A REVERSIBLE CHILD RESISTANT CAP

(75) Inventors: David A. Miceli, Spencer, TN (US); Joseph A. Miceli, Spencer, TN (US)

(73) Assignee: Tri State Distribution, Inc., Sparta, TN (US)

( * ) Notice: Subject to any disclaimer, the term of this patent is extended or adjusted under 35 U.S.C. 154(b) by 345 days.

This patent is subject to a terminal disclaimer.

(21) Appl. No.: 12/130,031

(22) Filed: May 30, 2008

(65) Prior Publication Data

US 2008/0223811 A1 Sep. 18, 2008

Related U.S. Application Data

(63) Continuation of application No. 11/463,591, filed on Aug. 10, 2006, now Pat. No. 7,571,826, which is a continuation of application No. 11/114,613, filed on Apr. 26, 2005, now Pat. No. 7,108,145, which is a continuation of application No. 10/986,948, filed on Nov. 12, 2004, now Pat. No. 7,070,063, which is a continuation of application No. 10/302,954, filed on Nov. 25, 2002, now Pat. No. 6,926,161, which is a continuation of application No. 10/236,940, filed on Sep. 9, 2002, now Pat. No. 6,523,709, which is a continuation of application No. 09/794,157, filed on Feb. 28, 2001, now Pat. No. 6,446,823.

(60) Provisional application No. 60/185,706, filed on Feb. 29, 2000.

(51) Int. Cl.

| | |
|---|---|
| ***B65D 41/06*** | (2006.01) |
| ***B65D 41/34*** | (2006.01) |
| ***B65D 41/00*** | (2006.01) |
| ***B65D 50/06*** | (2006.01) |
| ***B65D 43/00*** | (2006.01) |

(52) U.S. Cl. ..... 215/228; 215/201; 215/222; 215/332; 215/329; 215/44; 215/45

(58) Field of Classification Search ..... 215/222, 215/201, 211, 216, 217, 228, 219, 220, 44, 215/45, 334

See application file for complete search history.

(56) References Cited

U.S. PATENT DOCUMENTS

| | | | |
|---|---|---|---|
| 942,141 | A | 12/1909 | Hoffman |
| 1,435,723 | A | 11/1922 | Mayer |
| 3,032,226 | A | 5/1962 | Terwilliger |
| 3,072,276 | A | 1/1963 | Nichols |
| 3,344,942 | A | 10/1967 | Hedgewick |
| 3,371,808 | A | 3/1968 | Velt |
| 3,435,975 | A | 4/1969 | Weigand |

(Continued)

FOREIGN PATENT DOCUMENTS

| | | |
|---|---|---|
| DE | 2533230 | 2/1977 |

(Continued)

*Primary Examiner* — Robin Hylton

(74) *Attorney, Agent, or Firm* — Luedeka, Neely & Graham, PC

(57) ABSTRACT

The present invention relates to a reversible child resistant cap and a closure system having two positions, the first being a child resistant position and the other being a non-child resistant position.

18 Claims, 10 Drawing Sheets

U.S. PATENT DOCUMENTS

| | | | | |
|---|---|---|---|---|
| 3,557,985 | A | | 1/1971 | St. Denis et al. |
| 3,612,324 | A | | 10/1971 | Malick |
| 3,613,928 | A | | 10/1971 | Landen |
| 3,794,200 | A | | 2/1974 | Marks |
| 3,809,276 | A | | 5/1974 | Landen |
| 3,865,267 | A | | 2/1975 | Morris |
| 3,880,313 | A | | 4/1975 | Akers |
| 3,880,314 | A | | 4/1975 | Akers |
| 3,926,325 | A | | 12/1975 | Benson |
| 3,951,289 | A | | 4/1976 | Landen |
| 3,974,928 | A | | 8/1976 | Domaracki et al. |
| 4,053,078 | A | * | 10/1977 | Herr ..... 215/222 |
| 4,103,797 | A | | 8/1978 | Morris |
| RE29,779 | E | | 9/1978 | Morris |
| 4,337,869 | A | | 7/1982 | Guinle |
| 4,383,619 | A | | 5/1983 | Mumford et al. |
| 4,387,821 | A | | 6/1983 | Geiger |
| 4,406,376 | A | | 9/1983 | Berghahn |
| 4,452,364 | A | | 6/1984 | Kay |
| 4,526,281 | A | | 7/1985 | Herr |
| 4,579,238 | A | | 4/1986 | Herr |
| 4,579,239 | A | | 4/1986 | Hart |
| 4,634,013 | A | | 1/1987 | Bar-Kokhba |
| 4,694,968 | A | | 9/1987 | Proctor et al. |
| 4,823,967 | A | | 4/1989 | Thompson |
| 5,115,928 | A | | 5/1992 | Drummond, Jr. |
| 5,190,178 | A | | 3/1993 | Luch |
| 5,213,323 | A | | 5/1993 | Novinsky |
| 5,297,687 | A | | 3/1994 | Freed |
| 5,449,078 | A | | 9/1995 | Akers |
| 5,464,110 | A | | 11/1995 | Heyworth |
| 5,579,934 | A | | 12/1996 | Buono |
| 5,711,442 | A | | 1/1998 | Kusz |
| 5,819,968 | A | | 10/1998 | Jones |
| 5,836,465 | A | | 11/1998 | King |
| 5,865,330 | A | | 2/1999 | Buono |
| 5,899,348 | A | | 5/1999 | Konefal et al. |
| 5,924,588 | A | | 7/1999 | Brennan |
| 5,927,532 | A | | 7/1999 | Traub |
| 5,934,492 | A | | 8/1999 | Jones |
| 6,082,565 | A | | 7/2000 | Harrold |
| 6,446,823 | B2 | | 9/2002 | Miceli et al. |
| 6,523,709 | B2 | | 2/2003 | Miceli et al. |
| 6,926,161 | B2 | | 8/2005 | Miceli et al. |
| 7,070,063 | B2 | | 7/2006 | Miceli et al. |
| 7,108,145 | B2 | | 9/2006 | Miceli et al. |
| 7,571,826 | B2 | * | 8/2009 | Miceli et al. ..... 215/228 |

FOREIGN PATENT DOCUMENTS

| | | | |
|---|---|---|---|
| EP | 0792818 | A1 | 9/1997 |
| FR | 2471329 | | 12/1979 |
| GB | 2182649 | A | 5/1987 |
| WO | 9004546 | A2 | 5/1990 |

* cited by examiner

REVERSIBLE CHILD RESISTANT CAP AND COMBINATION OF A CONTAINER AND A REVERSIBLE CHILD RESISTANT CAP

CROSS-REFERENCES TO RELATED APPLICATIONS

This application is a Continuation application which claims benefit of co-pending U.S. patent application Ser. No. 11/463,591 filed Aug. 10, 2006, entitled "Reversible Child Resistant Cap and Combination of a Container and a Reversible Child Resistant Cap", which is a Continuation application claiming benefit of U.S. patent application Ser. No. 11/114,613 filed Apr. 26, 2005, entitled "Reversible Child Resistant Cap and Combination of a Container and a Reversible Child Resistant Cap", now issued as U.S. Pat. No. 7,108,145 on Sep. 19, 2006 which is a Continuation application claiming benefit of U.S. patent application Ser. No. 10/986,948 filed Nov. 12, 2004, entitled "Reversible Child Resistant Cap and Combination of a Container and a Reversible Child Resistant Cap", now issued as U.S. Pat. No. 7,070,063 on Jul. 4, 2006 which is a Continuation application claiming benefit of U.S. patent application Ser. No. 10/302,954 filed Nov. 25, 2002, entitled "Reversible Child Resistant Cap and Combination of a Container and a Reversible Child Resistant Cap", now issued as U.S. Pat. No. 6,926,161 on Aug. 9, 2005, which is a Continuation application claiming benefit of U.S. patent application Ser. No. 10/236,940 filed Sep. 9, 2002, entitled "Reversible Child Resistant Cap and Combination of a Container and a Reversible Child Resistant Cap", now issued as U.S. Pat. No. 6,523,709 on Feb. 25, 2003, which is a Continuation application claiming benefit of U.S. patent application Ser. No. 09/794,157 filed Feb. 28, 2001, entitled "Reversible Child Resistant Cap and Combination of a Container and a Reversible Child Resistant Cap", now issued as U.S. Pat. No. 6,446,823 on Sep. 10, 2002, which claims benefit of U.S. patent application Ser. No. 60/185,706 filed Feb. 29, 2000. These applications and patents are hereby incorporated by reference in their entireties.

TECHNICAL FIELD AND INDUSTRIAL APPLICABILITY

The present invention relates to a reversible child resistant cap. Specifically, the invention relates to a cap which may be applied to a vial or other container in one of two positions, the first being a child resistant position and the second being a non-child resistant position. The child resistant position provides an obstacle to children being able to remove the cap from the container, whilst the non-child resistant position allows for ready removal of the cap from the container. The present invention also provides a reversible child resistant cap and container assembly.

BACKGROUND OF THE INVENTION

There are many varying types of child resistant closure systems disclosed in the art. An example of a particular type of child resistant closure system is disclosed in U.S. Pat. No. 5,449,078, which relates to a combination of a container and safety cap. The aforementioned patent is herein incorporated by reference.

While many child resistant caps effectively provide protection against the danger of small children being able to remove potentially harmful pills from vials or other containers, they also provide a problem for a considerable portion of the adult population that require medication, however, lack the manual dexterity or strength to remove the child resistant cap. This is of a particular concern to the elderly population or people suffering from arthritis and other disabilitating diseases.

Accordingly, this problem has been addressed by the development of closure systems having a child resistant mode and a non-child resistant mode such that, in the non-child resistant mode, the caps are more easily opened by adults. However, many such caps have a complex, multi part, structure making the caps expensive or the closure systems suffer from the problem of providing an inferior moisture and air barrier when used in the non-child resistant mode. Further, other attempts to develop reversible child resistant closure systems have resulted in caps that when used in their non-child resistant mode tended to come off from the vial or container inadvertently, for example, when being carried in a bag with other articles.

In light of the foregoing, there is a need for a reversible child resistant closure that overcomes the aforementioned deficiencies of the prior art.

SUMMARY OF THE INVENTION

Accordingly, the present invention is directed to a reversible child resistant cap and closure system that substantially obviates one or more of the problems due to limitations and disadvantages of the related art.

Additional features and advantages of the invention will be set forth in the description that follows, and in part will be apparent from the description, or may be learned by practice of the invention. The objectives and other advantages of the invention will be realized and attained by the system particularly pointed out in the written description and claims hereof as well as the appended drawings.

To achieve these and other advantages and in accordance with the purpose of the invention, as embodied and broadly described, the invention provides a reversible child resistant cap. In the first position, or child resistant position, the cap when applied to a container provides an effective protection against children being able to remove the closure, whilst at the same time allow ready removal of the cap by normal adults. In the second position, or the non-child resistant position, the cap allows for easy removal of the cap from the container even by persons whose ability to use their hands is severely limited.

In another embodiment, the present invention also provides a reversible child resistant closure system, comprising the combination of a container and reversible child resistant cap.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate several embodiments of the invention and together with the description serve to explain the principles of the invention.

DETAILED DESCRIPTION OF THE PREFERRED EMBODIMENTS OF THE PRESENT INVENTION

Figure 1:
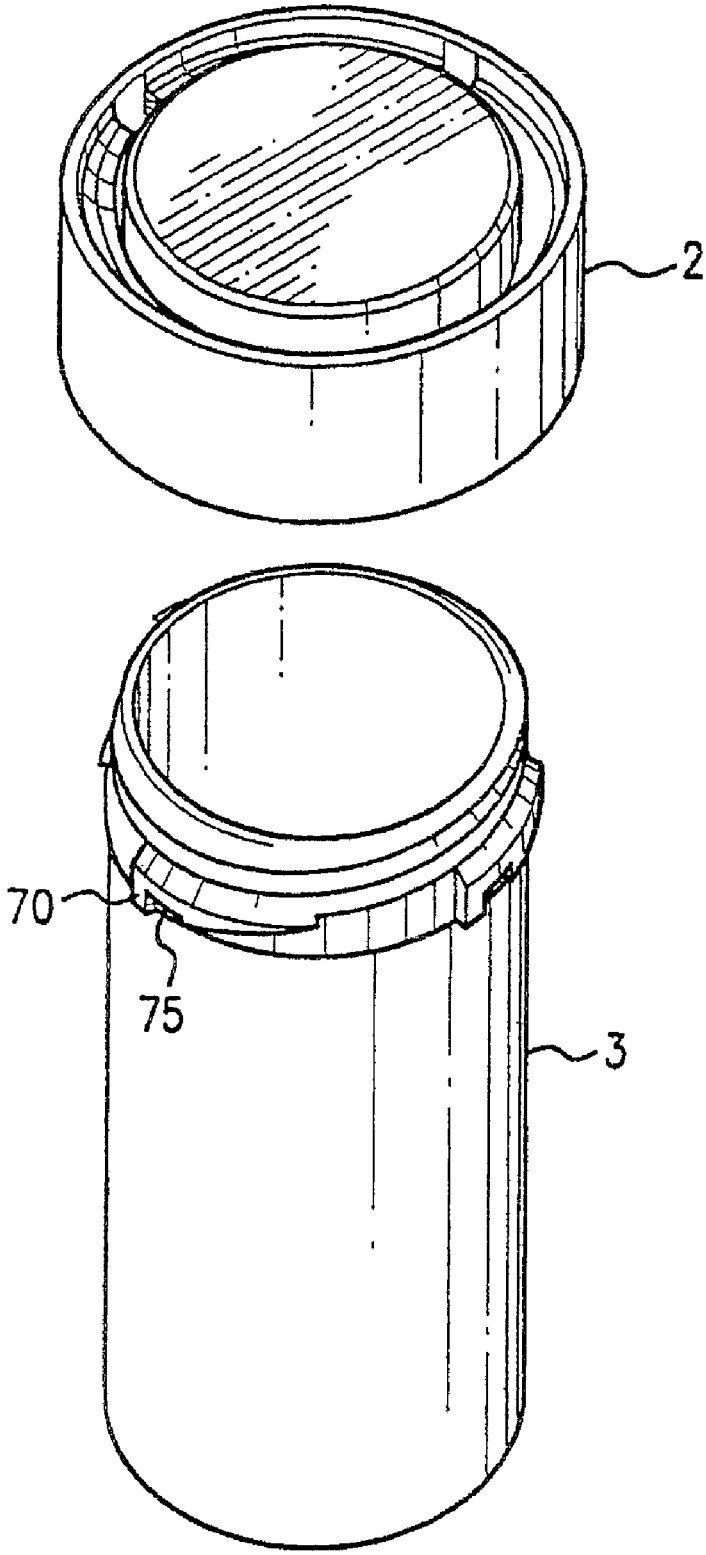
FIG. 1 is a perspective view of an embodiment of the reversible child resistant cap and container assembly in its first child resistant position.
Figure 3:
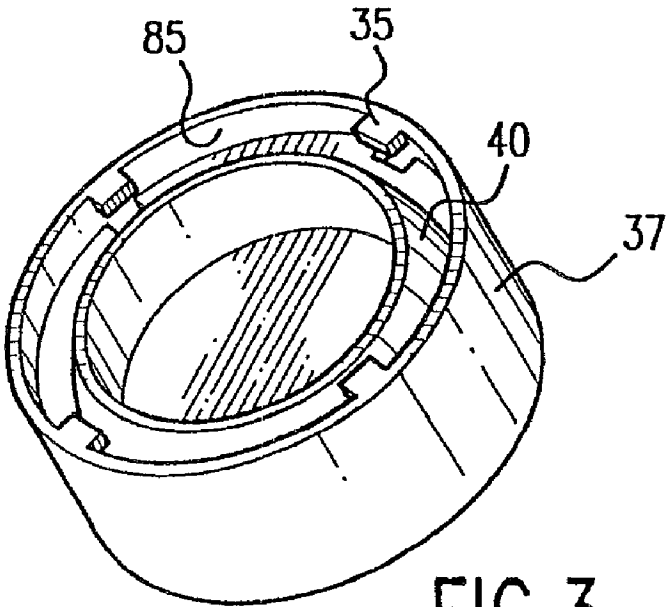
FIG. 3 is a perspective view of the cap of FIG. 1 in its second non-child resistant position.
Figure 2:
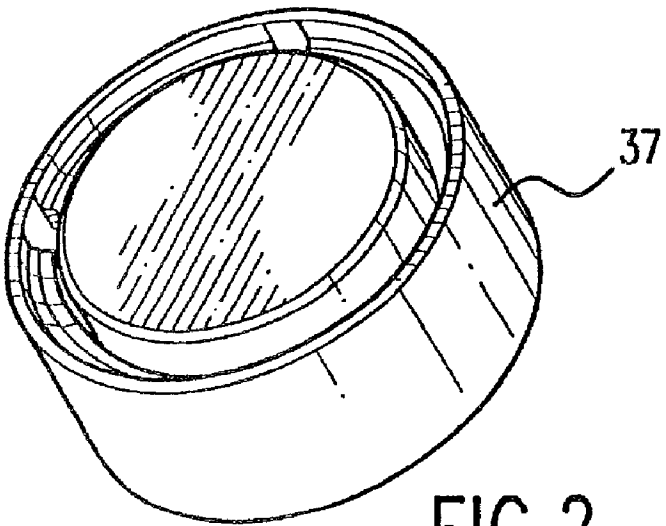
FIG. 2 is a perspective view of the cap of FIG. 1 in its first child resistant position.

Referring now to the drawings of the present disclosure in which like numbers represent the same structure in the various views, a perspective view of an embodiment of the reversible child resistant closure system of the present invention is shown generally at 1 in FIG. 1 and comprises a reversible child resistant cap 2 and a container 3. Specifically, FIG. 1 shows the reversible child resistant closure system in the first child resistant position. Thus, when the closure system is in the first child resistant position the child resistant engaging means of the cap mates with the child resistant engaging means on the container. However, the cap 2 may also be used in an inverted orientation, as shown in FIG. 3, i.e. in a second non-child resistant position. In this second non-child resistant position the non-child resistant engaging means of the cap engage with the non-child resistant engaging means of the container.

Figure 4:
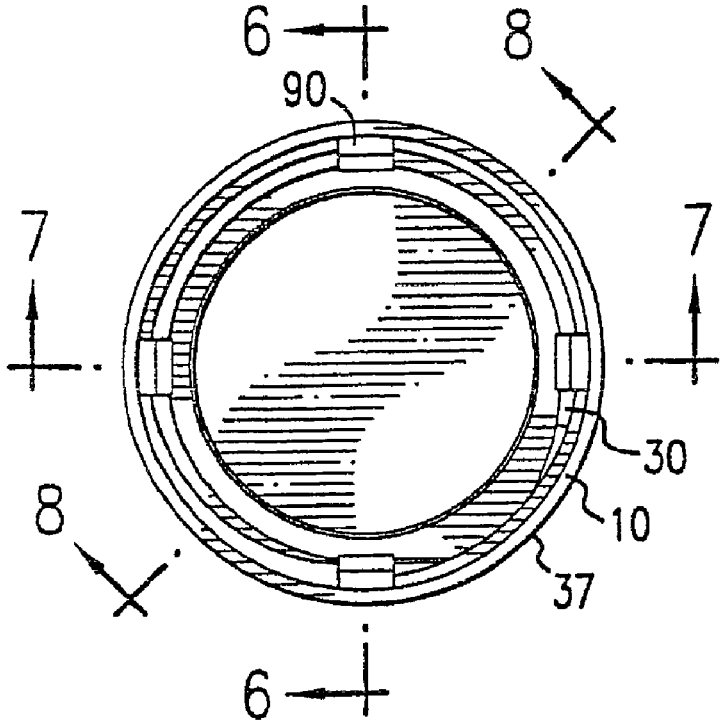
FIG. 4 is a top view of the cap of FIG. 1 in its first child resistant position.
Figure 5:
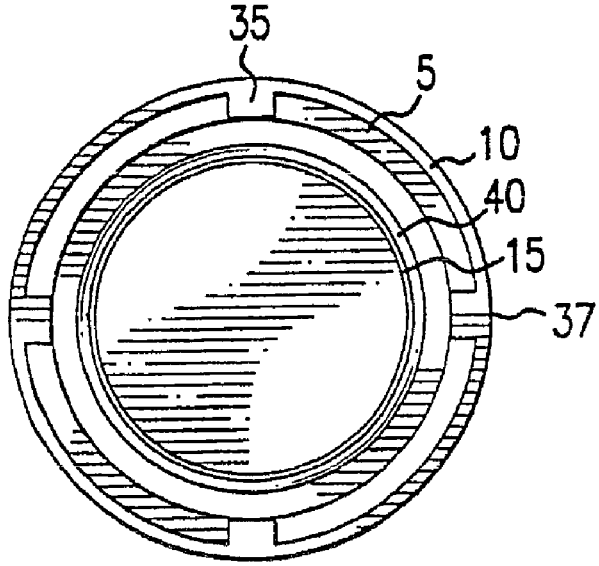
FIG. 5 is a bottom view of the cap of FIG. 1 in its first child resistant position.
Figure 6:
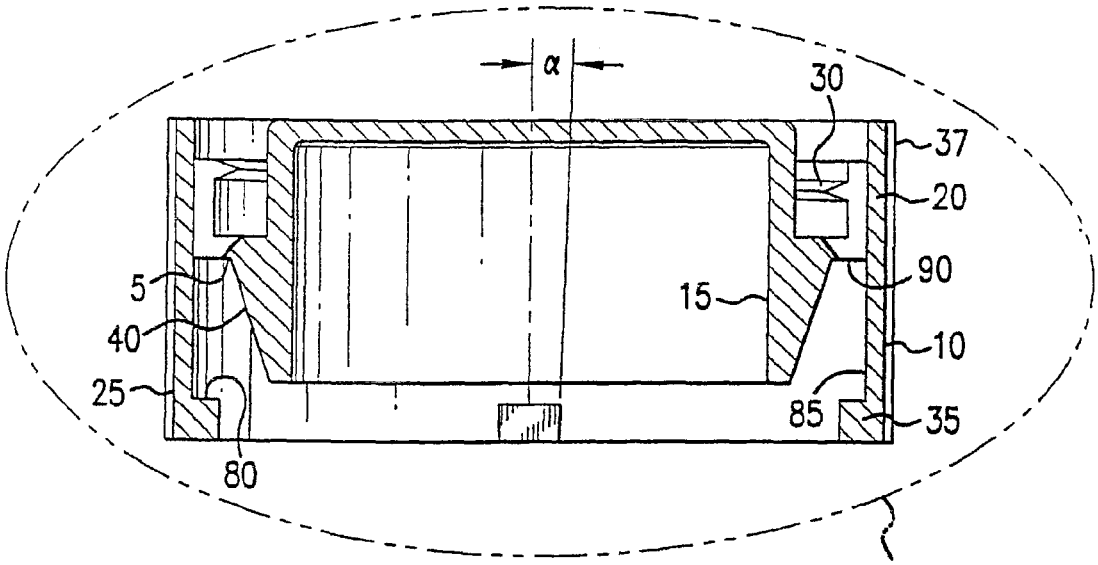
FIG. 6 is a cross sectional view of the cap of FIG. 4 as viewed along line 6-6 of FIG. 4.
Figure 7:
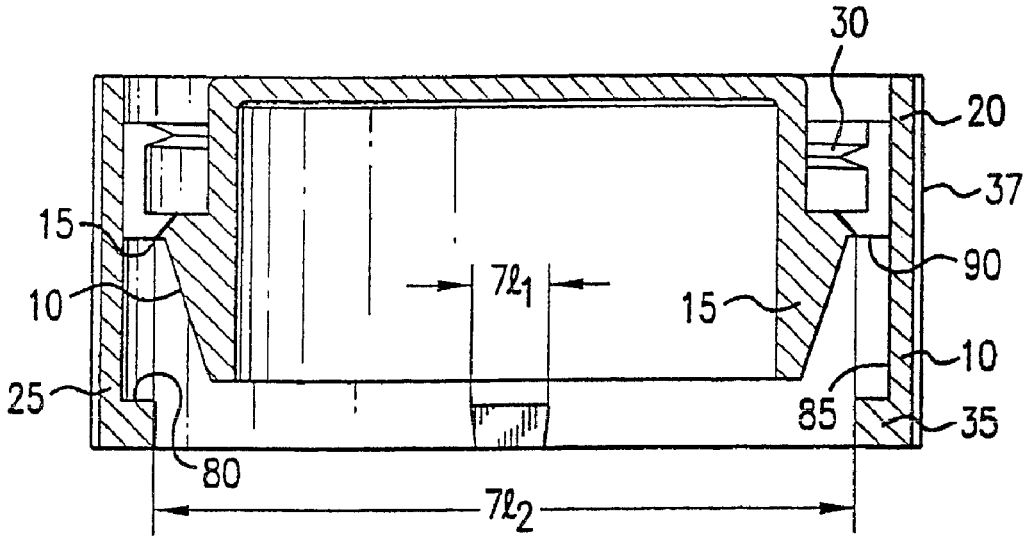
FIG. 7 is a cross sectional view of the cap of FIG. 4 as viewed along line 7-7 of FIG. 4.
Figure 8:
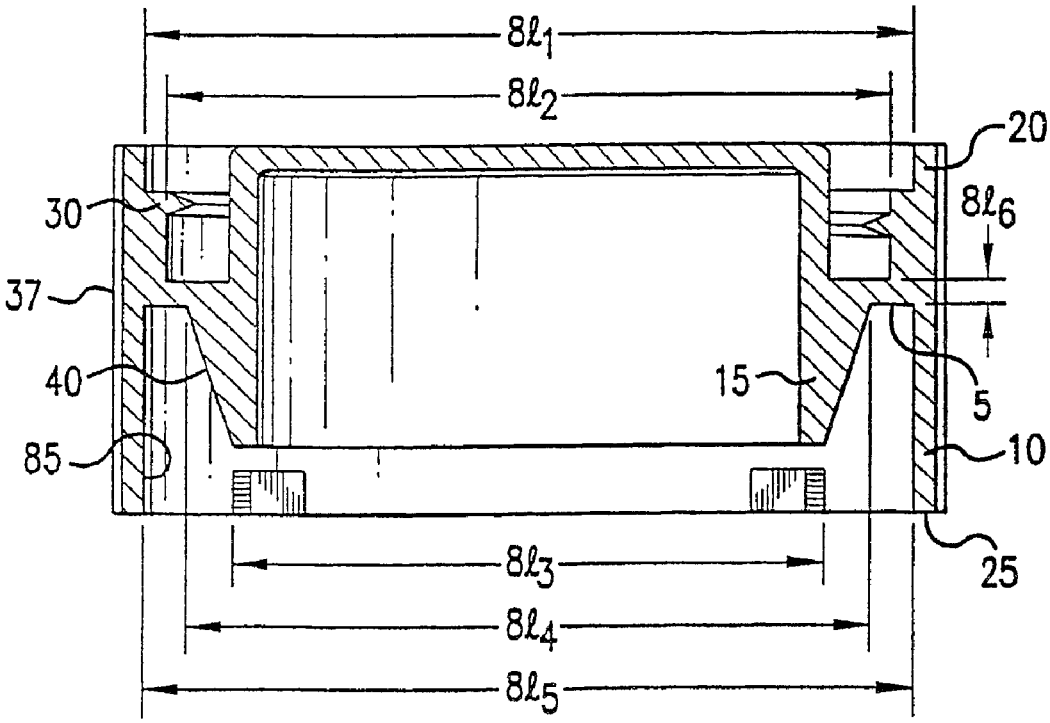
FIG. 8 is a cross sectional view of the cap of FIG. 4 as viewed along line 8-8 of FIG. 4.

FIGS. 6, 7 and 8 are cross sectional views of a preferred embodiment of the cap 2 depicted in FIG. 4. taken along lines 6-6, 7-7, and 8-8 respectively. A more detailed view of FIG. 6 is provided by FIG. 9. As shown in FIGS. 4-9, the reversible child resistant cap 2 includes a closure plane 5, a circumferential outer skirt 10, and a circumferential resilient depending inner member 15.

The circumferential outer skirt 10 comprises an upper portion 20 extending in an upward direction from the closure plane 5. The outer skirt 10 also comprises a lower portion 25 extending in a downward direction from the closure plane 5. The upper portion 20 of the circumferential outer skirt comprises a non-child resistant engaging means for engaging the container. Any suitable non-child resistant engaging means may be used. Suitable examples include an endless closure bead, a thread bead, and a double thread bead. FIGS. 4-9 depict a thread bead 30 as the non-child resistant engaging means, however, a double entry thread bead is preferred. The lower portion 25 of the circumferential outer skirt 10 comprises a child resistant engaging means for engaging the container 3. Any suitable child resistant engaging means may be used. In the preferred embodiment shown in FIGS. 2-9 the suitable child resistant engaging means comprises one or more locking lugs 35.

The circumferential outer skirt 10 may also comprise a gripping means to facilitate rotation of the cap 2 to aid in both putting the cap onto the container and then the subsequent removal of the cap 2. Any suitable gripping means maybe utilized. In a preferred embodiment, knerlments 37 are disposed about the outer surface of the outer skirt 10.

The circumferential resilient depending inner member 15 has an outer surface 40 which is tapered from a larger diameter portion adjacent the closure plane 5 to a smaller diameter portion remote from the closure plane 5.

Figure 10:
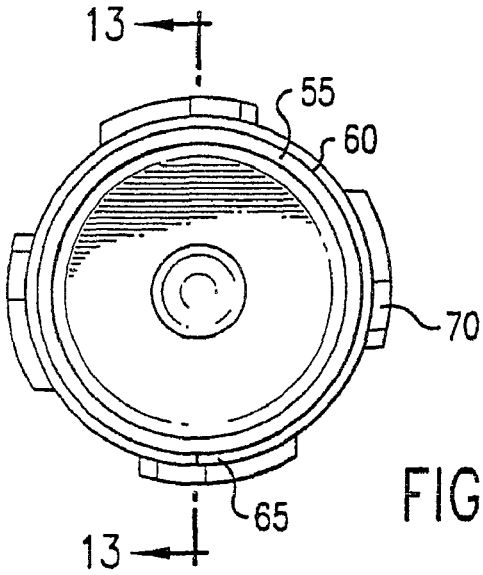
FIG. 10 is a top view of a first embodiment of the container of the present invention.
Figure 11:
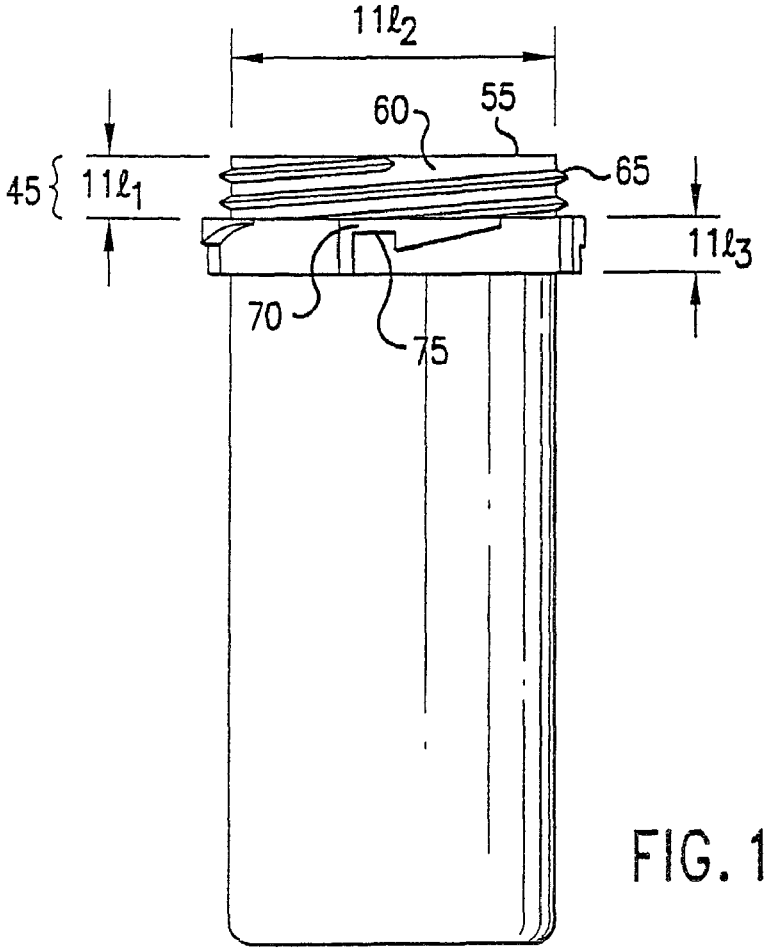
FIG. 11 is a side view of the first embodiment of the container of the present invention.
Figure 12:
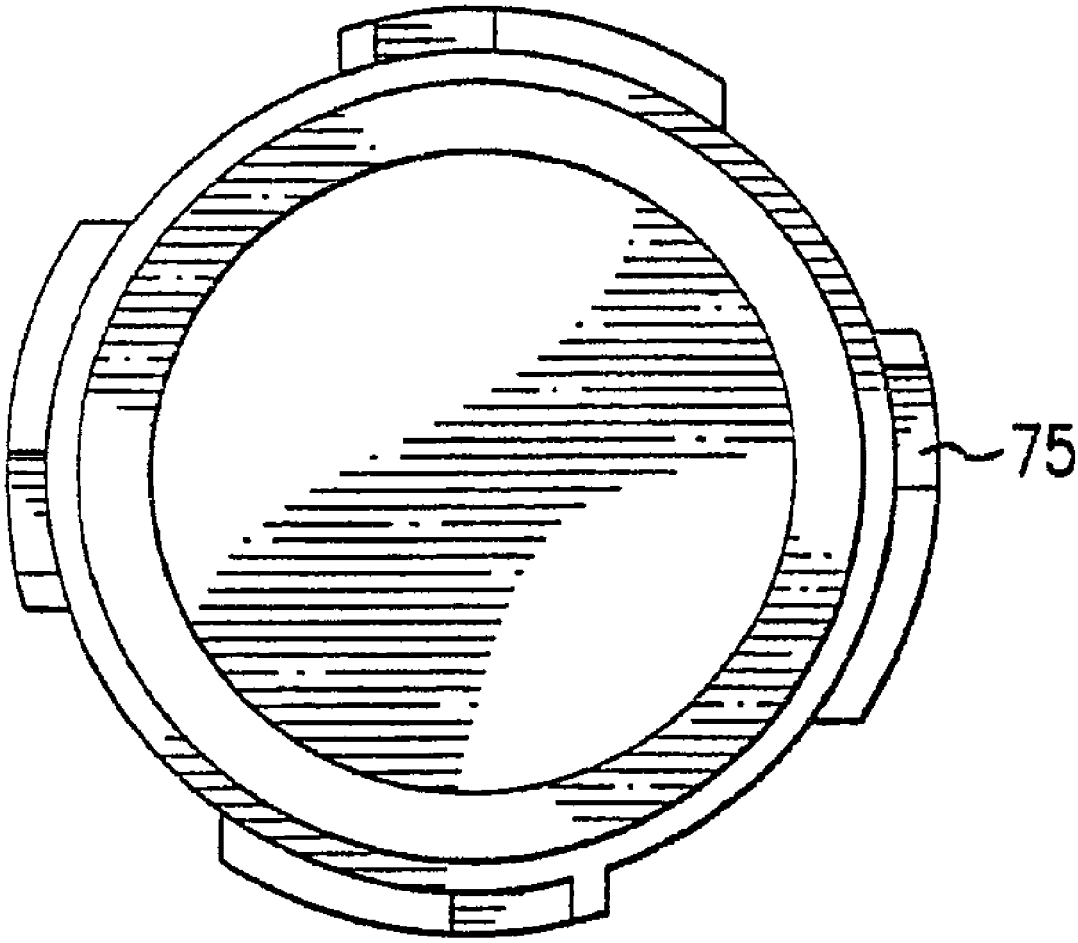
FIG. 12 is a bottom view of the first embodiment of the container of the present invention.
Figure 13:
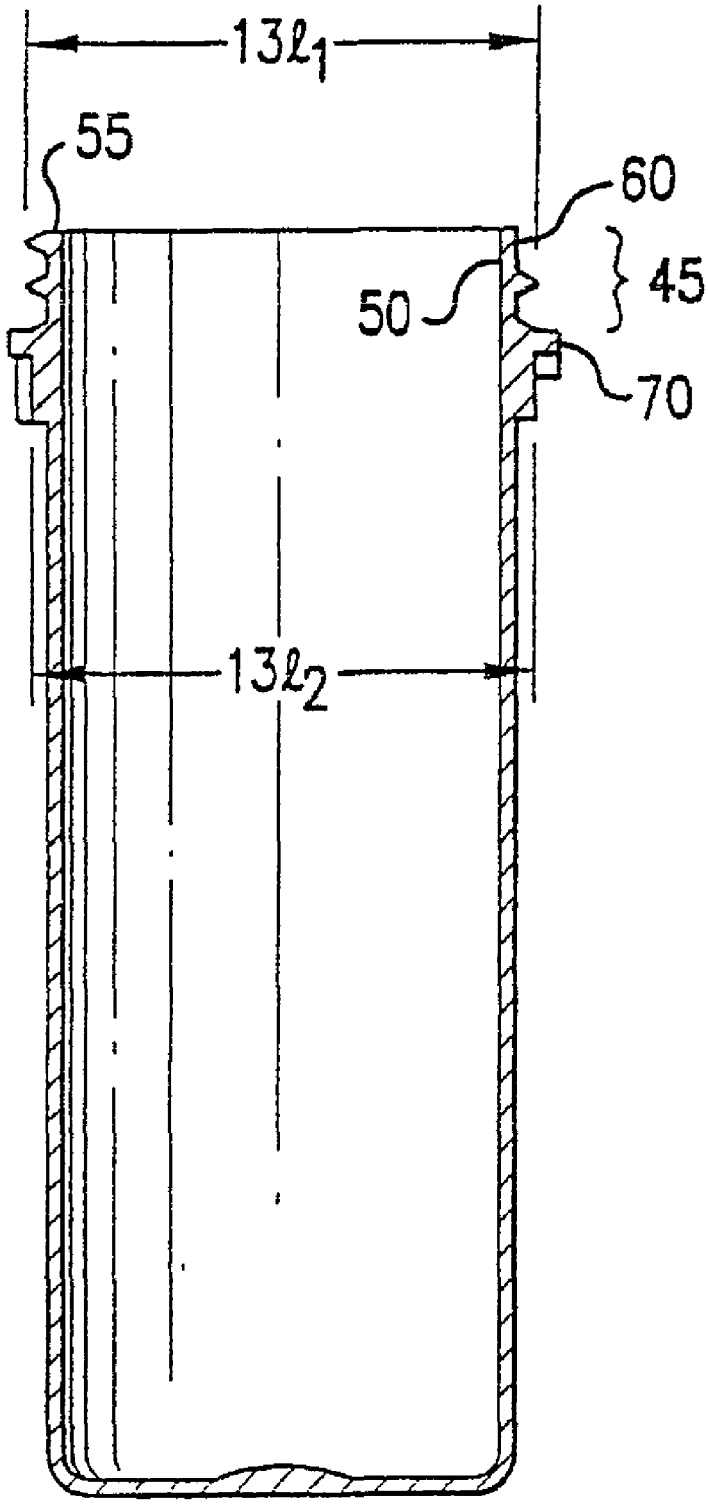
FIG. 13 is a cross sectional view of the container depicted in FIG. 10 as viewed along line 13-13 of FIG. 10.

Referring to FIGS. 11-13, the container 3 has a neck portion 45 having an inner surface 50 for engaging the tapered outer surface 40 of the cap 2. When the closure system of the present invention is used in the first child resistant position, the inner surface 50 engages the tapered outer surface 40 of the cap to provide a seal. Further, the neck portion 45 is preferably made such that when the inner surface 50 engages the outer surface 40, the neck portion 45 bends or flexes in an outward direction to provide a bias on the cap 2 in a direction of removal of the cap 2. The neck 45 may have any suitable construction to provide the bias on the cap 2. For example, the neck 45 may have a thickness sufficiently thin such that the neck 45 flexes or bends in an outward direction when the cap 2 is locked in the first child resistant position. The neck 45 of the container 3 also comprises a top edge surface 55 which contacts the closure plane 5 of the cap 2 when the closure system is in the second non-child resistant position. This contact of the top edge surface 55 and the closure plane 5 is sufficient to form a seal. A non-child resistant engaging means is disposed about the outer surface 60 of the neck 45 to engage the non-child resistant engaging means of the cap 2. Any suitable engaging means may be used. Suitable engaging means may include an endless bead, a thread bead, and a double entry thread bead. As shown in FIGS. 10 and 11, in a preferred embodiment a double entry thread bead 65 is used.

The container 3 also comprises a child resistant engaging means disposed on the container remotely from the neck 45 to cooperate with the child resistant engaging means of the cap 2. In a preferred embodiment, the child resistant engaging means disposed on the container cooperates with the child resistant engaging means on the cap 2 to prevent the cap 2 from being removed from the container without the simultaneous depression and rotation of the cap 2 on the container 3. Referring now to FIG. 11 the child resistant engaging means on the container 3 comprises a camming latch 70 having a cam receiving notch 75 therein and in which the child resistant engaging means on the cap 2 comprises a locking lug 35 which is guided into the notch 75 upon rotation of the cap 2 on the container 3 when the cap 2 is applied to close and seal the container 3 in the first child resistant position.

Figure 14:
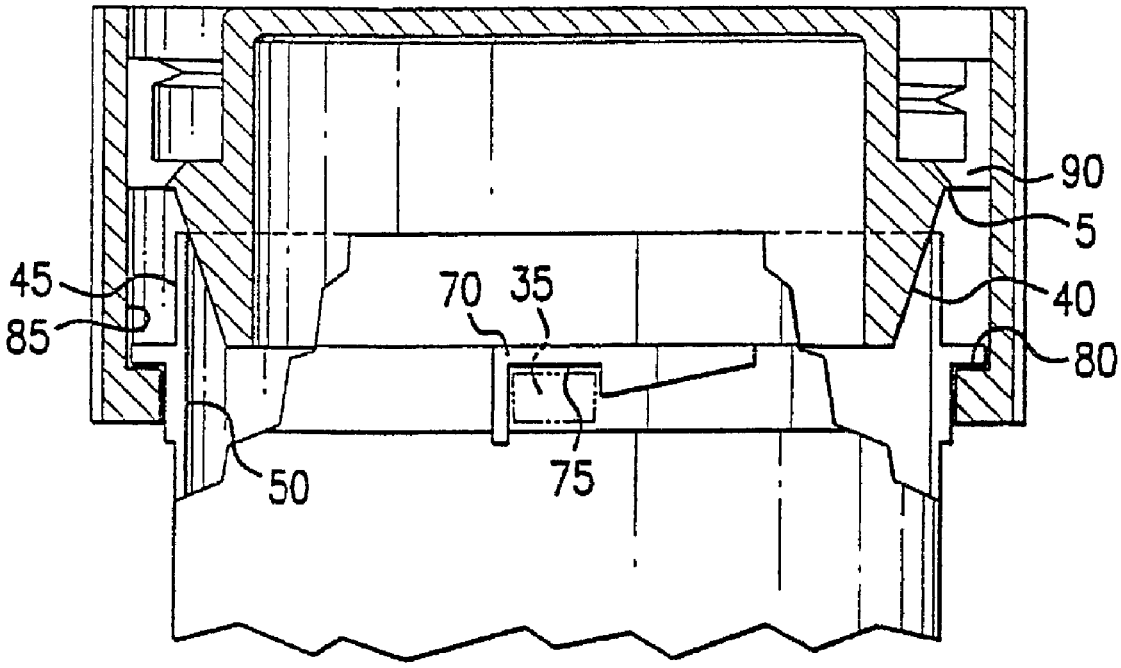
FIG. 14 is a fragmentary elevation view, partly in sectional, of the container and the neck thereof with the cap thereon in a locked and sealed position.

FIG. 14 represents the cap 2 on the container 3 in is first child resistant position with the locking lug 35 seated in notch 75 so that the cap 2 is locked on the container 3. The tapered outer surface 40 of the cap is disposed inside the inner surface 50 of the neck 45 of the container 3 causing an upward bias on the cap 2. Accordingly, the cap cannot be removed from the container merely by rotating the cap 2. Instead, the cap 2 must be depressed on the container to unseat the lock lug 35 from the notch 75 and then rotated in a counter clockwise direction so that the lock lug can be positioned between camming latch 70 and the next adjacent camming latch, so that the cap 2 can be removed by then directly upward motion.

In a particularly preferred embodiment, the cap 2 and the container 3 of the present invention have the following dimensions 7/.sub.1, 7/.sub.2, 8/.sub.1, 8/.sub.2, 8/.sub.3, 8/.sub.4, 8/.sub.5, 8/.sub.6, 9/.sub.1, 9/.sub.2, 9/.sub.3, 9/.sub.4, 9/.sub.5, 9/.sub.6, 9/.sub.7, 9/.sub.8, 9/.sub.10, 11/.sub.1, 11/.sub.2, 11/.sub.3, 13/.sub.1, and 13/.sub.2 as depicted in FIGS. 7, 8, 9, 11 and 13. In a more preferred embodiment angle .alpha. as depicted in FIG. 6 is about 3 degrees. In an even more preferred embodiment, some or all dimensions 7/.sub.1, 7/.sub.2, 8/.sub.1, 8/.sub.2, 8/.sub.3, 8/.sub.4, 8/.sub.5, 8/.sub.6, 9/.sub.1, 9/.sub.2, 9/.sub.3, 9/.sub.4, 9/.sub.5, 9/.sub.6, 9/.sub.7, 9/.sub.8, 9/.sub.10, 11/.sub.1, 11/.sub.2, 11/.sub.3, 13/.sub.1, and 13/.sub.2 are 0.125, 1.184, 1.313, 1.254, 1.010, 1.160, 1.314, 1.204, 1.020, 0.950, 0.040, 0.230, 0.615, 0.075, 0.230, 0.345, 0.150, 1.076, 0.090, 1.190, and 1.190 mm respectively.

Any suitable method known to one of ordinary skill in the art may be used to manufacture the cap 2 and container 3 of the present invention. However, to aid in the manufacture of the cap 2 of the present invention, comprising a locking lug 35, the cap 2 preferably comprises molding holes 90 positioned above each locking lug 35 such that portions of an upper mold may pass through the molding holes to form the top surface 80 of the locking lug 35. To retain the moisture and air barrier properties of the closure system, the molding holes 90 are positioned between the outer surface of the skirt 10 and the position at which the closure plane 5 contacts the top edge surface 55 of the container 3 when the cap 2 is applied to the container 3 in the second non-child resistant position. The use of molding holes 90 also enables the locking lug 35 to protrude a greater amount from the inner surface 85 of the lower portion 25 of the skirt 10 than would otherwise be achievable. In addition, the molding holes also allows the locking lug 35 to have a top surface 80 that is substantially perpendicular to the inner surface 85 of the lower portion 25 of the outer skirt 10.

Figure 9:
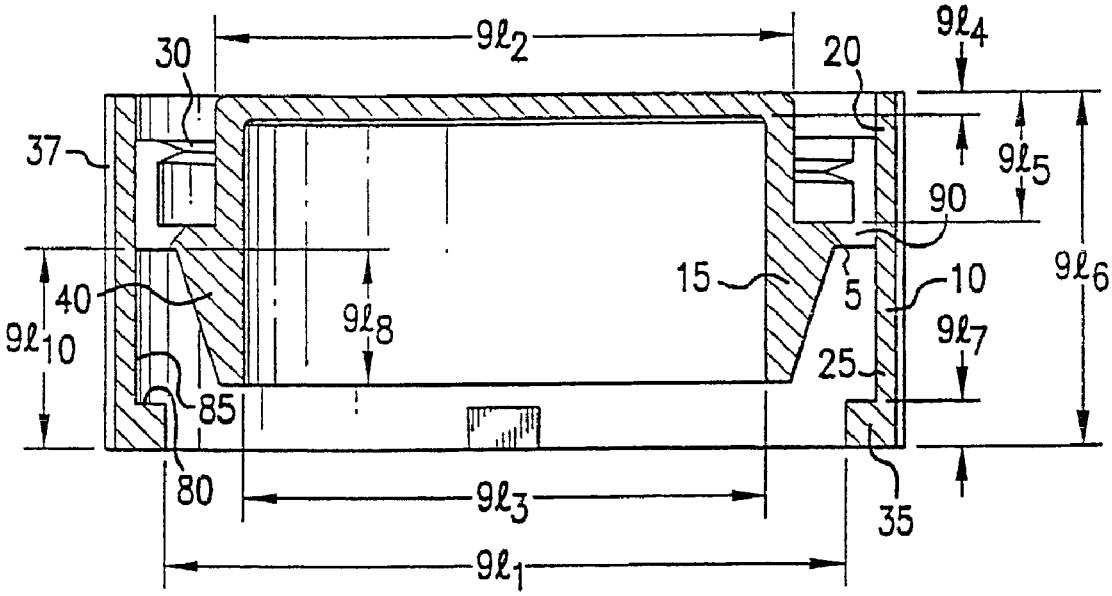
FIG. 9 is a more detailed view of FIG. 6.

As best seen in FIG. 4, the molding holes 90 separate the thread bead 30 into a plurality of circumferentially spaced thread bead segments separated by spaces or gaps defined by the molding holes 90. Also as best seen in FIG. 9, since each of the locking lugs 35 is located below one of the molding holes 90, the locking lugs 35 circumferentially alternate with the thread bead segments. As is further apparent by comparing FIGS. 4 and 5, each of the thread bead segments is circumferentially longer than each of the locking lugs 35.

Preferably, the cap is linerless, but liners may be provided if desired. The cap is preferably made from a plastic material, such as high density polyethylene (HDPE) or polypropylene. The container is preferably made from a plastic material, such as low density polyethylene (LDPE) or polypropylene. More preferably, the container is made from polypropylene. The skilled artisan, having the benefit of the instant disclosure, will readily appreciate that the caps and containers may be made from other suitable materials.

Numerous alterations of the structure herein disclosed will be apparent to one of ordinary skill in the art. However, it is understood that the present disclosure relates to preferred embodiments of the invention for the purposes of illustration only and should not be construed as to be a limitation of the invention. All such modifications and alterations which do not depart from the spirit of the invention are intended to be included within the appended claims.

What is claimed is:

1. A reversible child resistant cap apparatus for use with a container, the cap having a child resistant mode when applied to the container in a first child resistant position and having a non-child resistant mode when applied to the container in a second non-child resistant position, the cap comprising:

a connecting structure;

a circumferential outer skirt comprising an upper portion extending in an upward direction from the connecting structure, and a lower portion extending in a downward direction from the connecting structure, the upper and lower portions including upper and lower inner surfaces, respectively;

a circumferential inner skirt inside the circumferential outer skirt, the inner skirt having an upper end and a lower end, the inner skirt being connected to the outer skirt by the connecting structure;

a plurality of thread segments defined on the inner surface of the upper portion of the circumferential outer skirt for engaging the container when the cap is applied to the container in the second non-child resistant position, the thread segments being separated circumferentially by gaps; and a plurality of lugs defined on the inner surface of the lower portion of the circumferential outer skirt for engaging the container when the cap is applied to the container in the first child resistant position.

2. The apparatus in accordance with claim 1, wherein: the upper portion of the circumferential outer skirt includes an upper end; and the upper end of the inner skirt is closed and is positioned at substantially the same distance from the connecting structure as the upper end of the circumferential outer skirt.

3. The apparatus in accordance with claim 1, wherein: one of the lugs on the lower portion of the circumferential outer skirt is located below each of the gaps so that the lugs circumferentially alternate with the thread segments.

4. The apparatus in accordance with claim 1, wherein: the plurality of thread segments comprises a multiple entry thread.

5. The apparatus in accordance with claim 1, wherein: each of the thread segments are circumferentially longer than each of the lugs.

6. The apparatus in accordance with claim 1, further comprising: a container in combination with the cap, the container having an open upper end and having a plurality of camming latches defined on an exterior of the container, each camming latch including a notch for receiving one of the locking lugs; and the upper end of the container and the lower end of the inner skirt having a tapered seal defined therebetween, the tapered seal resiliently urging the cap away from the container so that the cap must be pushed down and rotated relative to the container to connect or disconnect the cap from the container in the child resistant mode.

7. The apparatus of claim 6, wherein: the tapered seal includes a tapered surface defined on the inner skirt adjacent the open lower end of the inner skirt, and a surface of the container engaging the tapered surface.

8. A reversible child resistant cap apparatus for use with a container, comprising:

a circular outer skirt having a first end and a second end;

a circular inner skirt concentrically disposed within the outer skirt;

a connecting structure connecting the outer skirt to the inner skirt;

the inner skirt having a first portion extending from the connecting structure, the first portion having an open first end;

the inner skirt having a second portion extending from the connecting structure such that an annular space is defined between the outer skirt and the second portion of the inner skirt, the second portion of the inner skirt having a closed second end positioned substantially coplanar with the second end of the outer skirt;

a plurality of circumferentially spaced bead segments extending from the outer skirt into the annular space;

a plurality of circumferentially spaced locking lugs extending radially inward from the outer skirt, the locking lugs being circumferentially positioned so that each locking lug is circumferentially located between two of the bead segments; and wherein the plurality of bead segments comprises a multiple entry thread bead.

9. A reversible child resistant cap apparatus for use with a container, comprising:

a circular outer skirt having a first end and a second end;

a circular inner skirt concentrically disposed within the outer skirt;

a connecting structure connecting the outer skirt to the inner skirt;

the inner skirt having a first portion extending from the connecting structure, the first portion having an open first end;

the inner skirt having a second portion extending from the connecting structure such that an annular space is defined between the outer skirt and the second portion of the inner skirt, the second portion of the inner skirt having a closed second end positioned substantially co-planar with the second end of the outer skirt;

a plurality of circumferentially spaced bead segments extending from the outer skirt into the annular space;

a plurality of circumferentially spaced locking lugs extending radially inward from the outer skirt, the locking lugs being circumferentially positioned so that each locking lug is circumferentially located between two of the bead segments; and wherein each of the bead segments are circumferentially longer than each of the locking lugs.

10. The apparatus in accordance with claim 8, wherein: the plurality of bead segments is equal in number to the plurality of locking lugs.

11. A reversible child resistant cap apparatus for use with a container, comprising:

a circular outer skirt having a first end and a second end;

a circular inner skirt concentrically disposed within the outer skirt;

a connecting structure connecting the outer skirt to the inner skirt;

the inner skirt having a first portion extending from the connecting structure, the first portion having an open first end;

the inner skirt having a second portion extending from the connecting structure such that an annular space is defined between the outer skirt and the second portion of the inner skirt, the second portion of the inner skirt having a closed second end positioned substantially co-planar with the second end of the outer skirt;

a plurality of circumferentially spaced bead segments extending from the outer skirt into the annular space;

a plurality of circumferentially spaced locking lugs extending radially inward from the outer skirt, the locking lugs being circumferentially positioned so that each locking lug is circumferentially located between two of the bead segments; and a container having an open upper end and having a plurality of camming latches defined on an exterior of the container, each camming latch including a notch for receiving one of the locking lugs; and a tapered seal defined between the container and the cap, the tapered seal resiliently urging the cap away from the container.

12. The apparatus in accordance with claim 11, wherein: the tapered seal includes a tapered outer surface defined on the first portion of the inner skirt.

13. A combination container and reversible child resistant cap assembly, comprising:

a container having an open upper end;

a cap reversible between a first position in which the cap engages the container in a child resistant first mode and a second position in which the cap engages the container in a non-child resistant second mode, the cap having a cylindrical outer skirt and cylindrical inner skirt, the outer skirt having a first end portion with a plurality of circumferentially spaced locking lugs engaging the container when the cap is in the first position, and the outer skirt having a second end portion with a plurality of circumferentially spaced engagement structures engaging the container when the cap is in the second position;

a resilient tapered seal between a first end of the inner skirt and the container resiliently urging the cap away from the container when the cap is in the first position; and wherein the second end portion of the outer skirt and a second end of the inner skirt are substantially co-planar, the second end of the inner skirt being closed.

14. The assembly of claim 13, wherein: each of the engagement structures is circumferentially located between two of the locking lugs.

15. A combination container and reversible child resistant cap assembly, comprising:

a container having an open upper end;

a cap reversible between a first position in which the cap engages the container in a child resistant first mode and a second position in which the cap engages the container in a non-child resistant second mode, the cap having a cylindrical outer skirt and cylindrical inner skirt, the outer skirt having a first end portion with a plurality of circumferentially spaced locking lugs engaging the container when the cap is in the first position, and the outer skirt having a second end portion with a plurality of circumferentially spaced engagement structures engaging the container when the cap is in the second position;

a resilient tapered seal between a first end of the inner skirt and the container resiliently urging the cap away from the container when the cap is in the first position; and wherein the engagement structures comprise thread segments.

16. The assembly of claim 15, wherein: each of the thread segments is circumferentially longer than each of the locking lugs.

17. The assembly of claim 15, wherein: the thread segments comprise a multiple entry thread.

18. The assembly of claim 15, wherein: the tapered seal includes a tapered outer surface defined on the first end of the inner skirt.

* * * * *